United States Patent [19]

Tellié

[11] 3,938,273

[45] Feb. 17, 1976

[54] FIREARM HAVING TWO PIVOTED PROPS

[76] Inventor: Paul E. Tellié, 20, rue Bergson, 42000 St. Etienne, France

[22] Filed: May 17, 1974

[21] Appl. No.: 470,857

[30] Foreign Application Priority Data

June 1, 1973 France ..... 73.19959

[52] U.S. Cl. ..... 42/94; 89/37 BA

[51] Int. Cl.[2] ..... F41C 29/00

[58] Field of Search ..... 42/94; 89/37 B, 37 BA

[56] References Cited

UNITED STATES PATENTS 1,431,058 10/1922 Sutter ..... 42/94

2,420,267 5/1947 Sefried ..... 42/94

*Primary Examiner*—Samuel Feinberg

*Assistant Examiner*—C. T. Jordan

*Attorney, Agent, or Firm*—Stevens, Davis, Miller & Mosher

[57] ABSTRACT

Two articulated props for a firearm are lockable in a firing or in a carrying position by a finger on the upper end of the props. A spring urges the finger into one or the other of two radial recesses provided on a trunnion protruding laterally from the firearm. The props can be unlocked by exerting a pull on the free end of the props so that the finger emerges from the recess.

9 Claims, 8 Drawing Figures

FIREARM HAVING TWO PIVOTED PROPS

The present invention relates to a firearm of the type having two pivoted props at its front portion, arranged to occupy at least one active position in which, their feet resting on the ground, they serve as support for the front portion of the firearm in order to maintain it inclined upward, and an inactive position in which they are swung back against the firearm.

In known manner, assault rifles, fully automatic rifles, machine guns and in general all firearms of substantial weight have props which can occupy at least one active or firing position in which they maintain the front end of the weapon in raised position with respect to the ground, and an inactive position, in particular a transportation position, in which they are substantially parallel to the barrel.

These props, of which there are necessarily two for each firearm, must impart excellent stability to the firearm when they are in the firing position, but must also not take up much space in their other inactive position. In particular, in this position they must not constitute any interference for the marksman.

At the present time, the locking of each prop in the two above-mentioned positions is assured either by a reversible device which is maneuvered by the prop, or by locking means which can be actuated by a pushbutton.

By "reversible device" is meant a device in which the locking or unlocking is effected by a direct action on the props.

The locking in the inactive position, and particularly in the active position, must, however, be sufficiently firm and, in order to effect the unlocking, for instance by pulling the props towards the rear in order to bring them from their active position into their inactive position, there is the danger of deforming them by flexure due to the substantial force which must be applied. If less firm a locking is provided in order to avoid this type of deformation, it rapidly proves to be too loose as a result of the play and wear of the cooperating parts, and it is then no longer capable of assuring, with the desired reliability, the holding of the props in their locked position.

As to the pushbutton locking means mentioned above, they have the drawback that they are of delicate operation, as the pushbuttons can easily be blocked by dust or mud which comes into their housing, or at least be subject because of this to rapid wear. Furthermore, they are of small dimensions and, being located at the end of the arm opposite the buttstock, are not readily accessible. In the dark, their actuation furthermore requires a rather lengthy groping.

The object of the present invention is in general to provide a firearm having two props which do not have these drawbacks.

In particular, one object of the invention is to provide props which are easily and rapidly unlockable so as to permit their being put into one of the two said positions, in particular without the unlocking requiring the actuating of a pushbutton of small size, which is frequently difficultly accessible, and the operation of which is difficult and may be disturbed or even prevented by the entrance of foreign substances such as dust or mud.

Another object of the invention is to provide a locking device which is irreversible, or possibly pseudoreversible, that is to say, in which the locking of the props in one or the other of their positions, whether active or inactive, is sufficiently permanently firm and in which the unlocking cannot in principle be obtained by a single direct action on the props directed at pivoting them, but is permitted only after an additional prior action carried out on them which is adapted then to permit their rotation without it being necessary to exert on the props a force which could deform them.

In order to do this, a firearm in accordance with the invention is characterized by the fact that each prop comprises:

- a head provided with a blind hole by means of which it can engage over a laterally protruding trunnion on the firearm, and with a radial extension in which there is provided a bore which slidably receives the end of a prop rod which is opposite its foot,
- means for the axial retention of the head on the trunnion, and
- within the head, means for the automatic locking of said end on the trunnion, in both the aforementioned positions, which means can be brought into unlocking position by a pull exerted on the rod in the direction of its axis.

As a result of this arrangement, as the locking means of each prop are completely housed within its head, they are protected from dust and other foreign matter.

Therefore, the operation of these locking means cannot be disturbed, even in an environment which is very disturbing for equipment in general, which characteristic, as it concerns reliability, constitutes an important advantage of the invention.

Furthermore, the unlocking of the props presents no difficulty even for the nighttime use of the firearm, or if the firearm is covered with mud, since it is always very easy to grasp the rods of the props and exert a pull on them so as to unlock them, which operation, as can be seen, does not require the action of a pushbutton.

Furthermore, due to the arrangement forming the object of the invention, a very firm locking of the props in their active position and in their inactive position can be provided without any risk of deformation when effecting their unlocking. As a matter of fact, unlocking is possible only after a pull has been exerted on the props, thereby freeing the lock. One can then turn the props around their trunnion without having to exert any substantial force on them.

In accordance with one embodiment of the invention, such a firearm is furthermore characterized by the fact that there is arranged within the bore of the radial extension of the head an elastic member which urges said end of the rod towards a retracted position in the head, and by the fact that this end bears a locking finger adapted to protrude radially into the blind hole and cooperate selectively with at least two radial recesses provided in the trunnion so as to assure locking in at least the two said positions.

Thus, in order to unlock the prop and bring it from its active position into its inactive position, or vice versa, it is sufficient to exert a longitudinal force on it in the direction towards its free end in order for the locking finger to emerge from the radial recess of the trunnion in which it was previously blocked and thereupon to pivot the prop until it arrives at the other selected position, in which position the locking finger, under the return force of the elastic member, penetrates into the other radial recess of the trunnion.

It will be seen that the locking of the props in their active or inactive position can be obtained easily and rapidly since, after having exerted a pull on the props in order to unlock them, it is merely necessary to pivot them until the locking finger comes opposite the recess intended for it and automatically houses itself therein under the action of the elastic member.

The elastic member is preferably compressed between a shoulder on the rod and a fixed stop on the radial extension of the rod.

This fixed stop may advantageously consist of a pin which passes through the radial extension of the head, as well as a notch in the rod, the upper and lower walls of which, by coming against the pin, serve to limit the sliding movements of the rod in the bore of the said extension.

In this way, when a pull is exerted on the prop rod in order to unlock it, it need not be feared that the prop will be removed entirely from the head since after the disengagement of the locking finger from its recess, the upper wall of the said notch comes against the pin, thus making inoperative any additional pulling force exerted on the prop.

Moreover, the different members which cooperate to effect the locking can be suitably dimensioned in such a manner that when the locking finger is in its recess, particularly the recess which corresponds to its active position, the lower wall of the notch abuts below the pin before the upper end of the locking finger itself comes against the bottom of its recess.

This arrangement avoids the weight of the firearm being supported by the locking finger when the props are locked in their active position, that is to say, in the firing position. On the contrary, when such an arrangement is provided, the weight of the firearm is supported by the pin and by the lower wall of the notch. Therefore, one avoids subjecting the locking finger to substantia stresses and the possibility of it being deformed, particularly as the firearm with its props in the active position should be capable of being placed on the ground without special care.

In accordance with a further embodiment of the invention which is particularly advantageous, at least one recess of the trunnion, with which the finger cooperates to assure the locking of the prop in an active position, has side walls which are flared towards the periphery of the trunnion.

This arrangement contributes toward eliminating the danger of deforming the locking fingers when the props, in their active position, have their free ends subjected to substantial longitudinal forces, which forces may be exercised, for instance, when the firearm is placed roughly upon the ground or else when, the weapon being carried, the props encounter obstacles such as underbrush, barbed wire or hillocks.

As a matter of fact, when such forces act on the ends of the props, the locking finger can slide along the flared side walls of the recess and emerge from it, these forces being transformed into a force which is directed along the axis of the prop rod and exerted against the return force of the elastic member. The locking is then pseudo-reversible but intended to be freed only under the action of a blow.

On the other hand, of course, the other recess of the trunnion, namely the one with which the finger cooperates to assure the locking of the corresponding prop in its inactive position, may have straight side walls, since, as the props are then swung back along the firearm, they are unlikely to encounter obstacles.

In order to facilitate the unlocking which is to take place under the effect of forces to which the props are subjected when they encounter obstacles or when the weapon is roughly planted on the ground, it is furthermore contemplated, in accordance with the invention, that the end of the locking finger be of rounded shape.

This shape, of course, facilitates the sliding of the end of the finger along the flared side walls of its recess.

Another particularly advantageous arrangement of the invention consists in the fact that the trunnion is provided at the end thereof opposite the firearm with a small collar which is adapted to fit in the bottom of the blind hole of the head and to guide the head upon its rotation and, in the portion thereof opposite said recesses, with a flat the shortest distance of which from the axis of the trunnion is less than the shortest distance between the end of the locking finger and the said axis.

This arrangement permits the rapid mounting and dismounting of the head of the prop on the corresponding trunnion without requiring the use of a tool.

As a matter of fact, after the unlocking has been effected in the manner indicated above, with the upper end of the the locking finger resting against the trunnion, it is sufficient, in order to remove the prop, to turn it until the finger arrives in the region of the flat. At this moment, due to the fact that the flat is located at a distance from the axis of the trunnion which is less than the shortest distance between the end of the locking finger and the said axis, that is to say, at the distance between the said axis and the end of the locking finger when the upper end of the prop is engaged to the maximum in the extension of the head, the end of this finger is free to be disengaged from the trunnion by a pull exerted on the head transversely with respect to the firearm, even if no pull is exerted on the other end of the prop. substantial In order to effect the mounting, the operations must be carried out in the opposite order, namely: the blind hole of the head of the prop is engaged on the trunnion by placing the prop in an angular position such that the locking finger comes into the region of the flat, which it is possible to do even if no pull is exerted on the free end of the prop, since the prop is rotated until the locking finger engages in one or the other of the recesses of the trunnion.

During the rotation of the head of the prop which is carried out either to mount it or to dismount it, the head is retained axially on the trunnion due to the fact that the locking finger cannot escape, as it is stopped by the collar. Furthermore, when the prop occupies its active position or its inactive position, the prop is not only locked in rotation but is also held axially on the trunnion due to the fact that, of course, the recesses are open only radially and that then the locking finger comes against each of their walls, which prevents any removal of the head, unless the locking finger is located in the region of the flat.

In accordance with the invention, the geometrical axes of the two trunnions form an angle such that in the active position the two props are spaced from each other in a plane substantially perpendicular to the axis of the firearm, and that upon their rotation towards their active position, they swing back along the firearm.

More specifically, in accordance with the invention, the geometric axes of the two trunnions form an angle of less than 180° in the upper portion of the plane, perpendicular to the axis of the arm, in which they are contained.

Several embodiments of the invention are shown by way of illustration and not of limitation in the figures of the accompanying drawing in which:

FIG. 1 is a side elevation of a firearm in accordance with the invention with the props in their active or firing position, FIG. 2 is a front elevation showing the firearm of FIG. 1, FIG. 3 is a partial view of the firearm with the props in their inactive position, FIG. 4 is a partial view of the firearm with the props in a position in which they can be disconnected from the trunnions, FIG. 5 is a view of the firearm partially in section showing in particular the locking means contained in the head of the prop, the prop being in its active position, FIG. 6 is a similar view showing another embodiment of the invention, FIG. 7 is a partial view in perspective, showing the arrangement of the geometrical axes of the trunnions, and FIG. 8 is a view of the firearm partially in section, similar to FIGS. 5 and 6, and showing still another embodiment of the invention.

DESCRIPTION OF THE PREFERRED EMBODIMENT:

Figure 1:
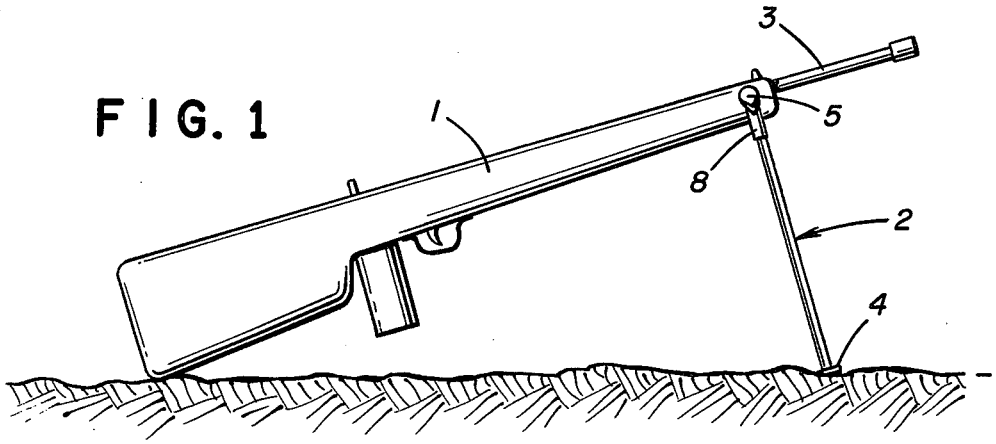
Figure 2:
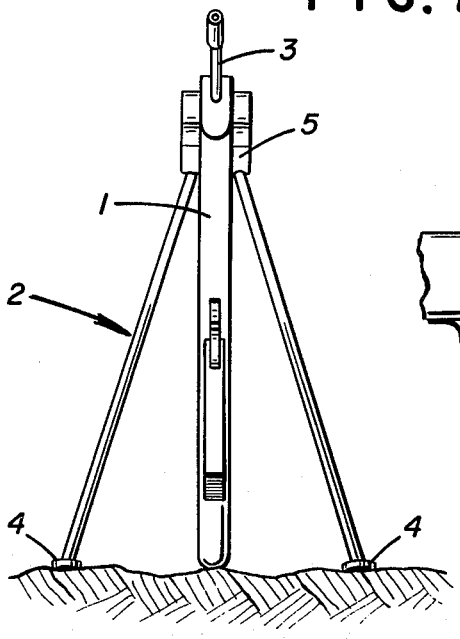
Figure 3:
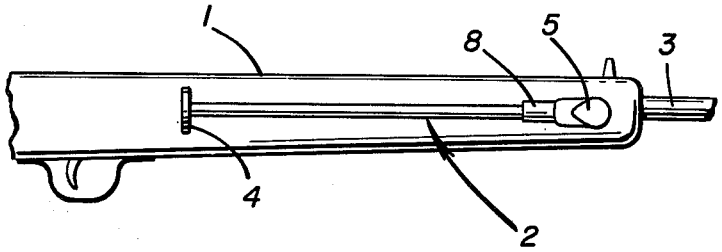
Figure 4:
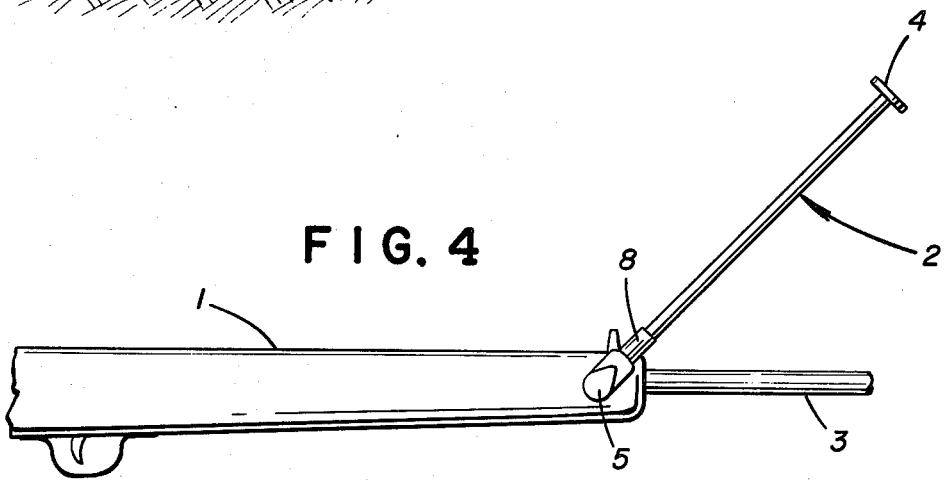

A firearm 1 in accordance with the invention is shown schematically in FIGS. 1 and 2 and partially in FIGS. 3, 4, 5, 6, 7 and 8. The firearm may, for instance, be a machine rifle. To the front end of the firearm there are pivoted two props 2 which can occupy an active position, in particular a firing position, in which they are spaced apart from each other in a plane substantially perpendicular to the axis of the barrel 3 (FIGS. 1, 2, 5, 6 and 8), and in an inactive position, in particular a carrying position, in which the props 2 are swung back along the firearm (FIG. 3). These props 2 are provided at their free ends with feet 4 intended to rest on the ground when the firearm is to be placed in a firing position in which its front portion is elevated.

The arrangement of a single one of the two props will be described below since the arrangement of the other prop is identical.

In accordance with the invention, the prop 2 comprises a head 5 in which there is provided a blind hole 6 by means of which the head can fit over a trunnion 7 (FIG. 7) protruding laterally from the firearm. The head has a radial extension 8 in which there is provided a bore 9 which slidably receives the end of a prop rod 10 which is opposite the foot 4.

Means for the automatic locking of the said end on the trunnion, in the active and inactive positions mentioned above, are arranged within the head 5.

These locking means comprise a portion 11 of reduced diameter forming an extension of the rod 10 within the bore 9, this portion bearing at its end a locking finger 12 which is adapted to protrude radially into the blind hole 6 and cooperate selectively with two radial recesses 13, 14 provided in the trunnion 7 so as to assure locking in each of the two positions indicated.

An elastic member 15, for instance a coil spring, is compressed between a shoulder 16 on the portion of reduced diameter 11 and a fixed stop on the radial extension 8 of the head 5. This stop is formed of a pin 17 which passes through the said radial extension 8 as well as a notch 18 provided at the junction between the rod 10 and its portion 11 of reduced diameter.

Figure 5:
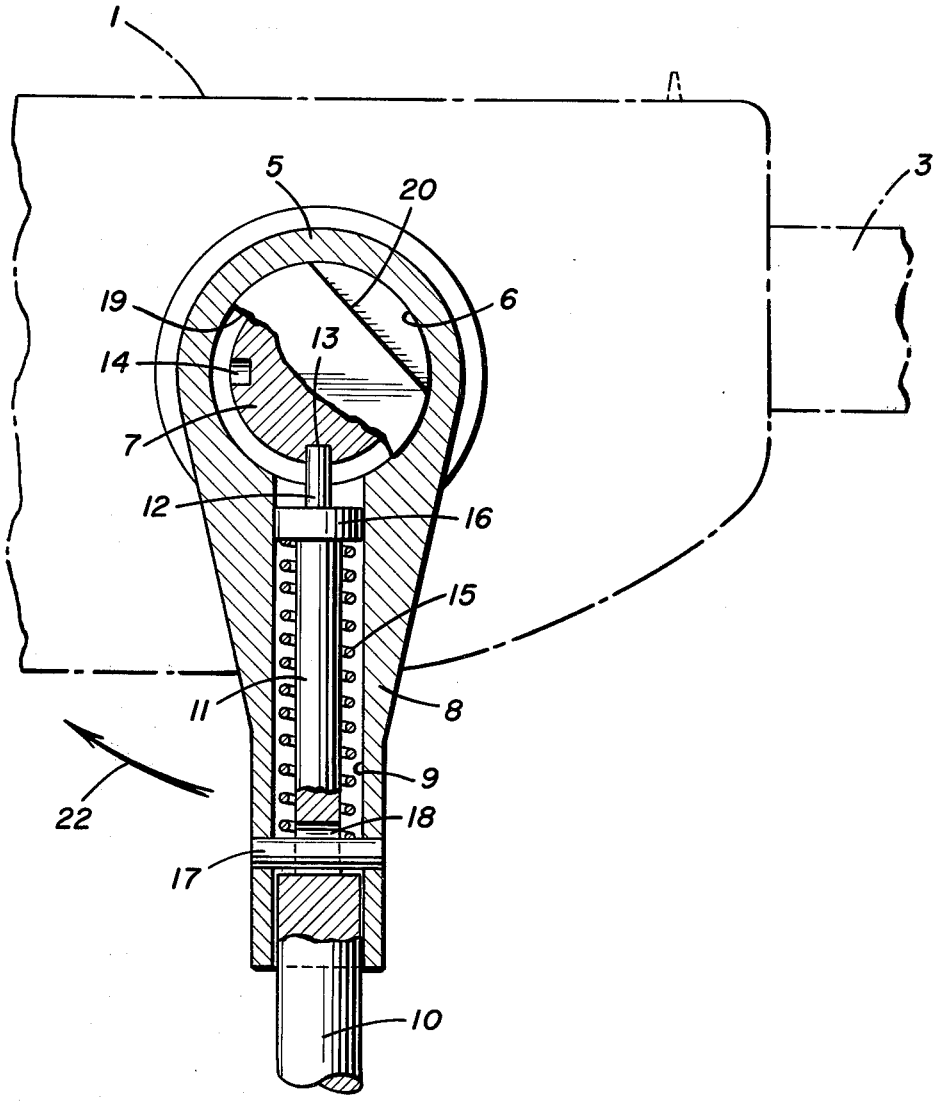
Figure 6:
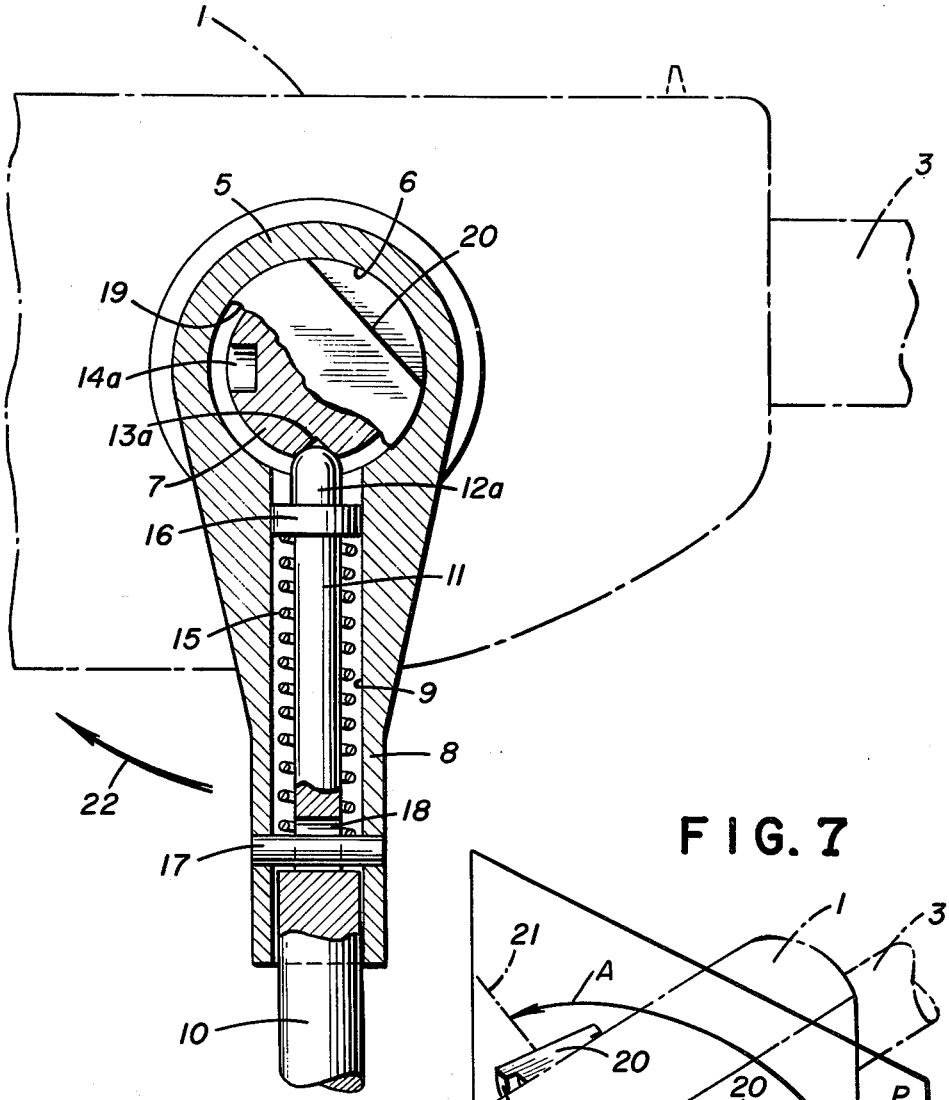
Figure 7:
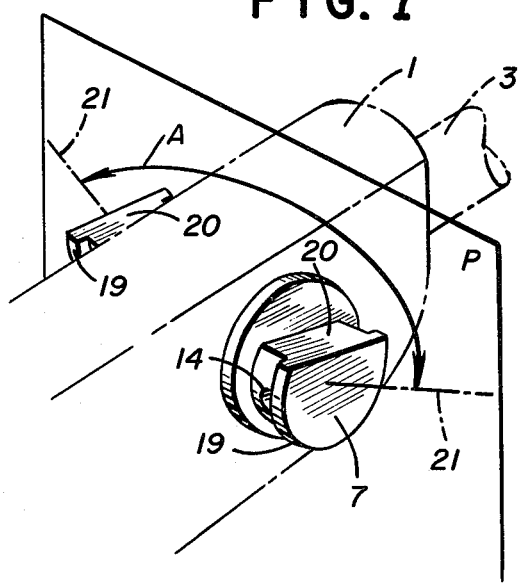

In the embodiment shown in FIG. 5, the side walls of the recesses 13, 14 are directed radially, the locking finger 12 being, for instance, of cylindrical shape, while in accordance with the embodiment of FIG. 6, the side walls of the recess **13*a* corresponding to the active position are flared outwards towards the periphery of the trunnion, said recess 13*a* possibly being formed of a conical cavity, and the locking finger 12*a* has an end of rounded shape, for instance hemispherical shape. In this latter embodiment, the other recess, namely the recess marked 14*a*, which corresponds to the inactive position, has radial side walls and a shape similar to that of the recesses 13, 14,** for instance a cylindrical shape.

Finally, the trunnion 7 is provided at its free end with a small collar 19 adapted to fit in the bottom of the blind hole 6 when the head is engaged on the trunnion and to guide said head upon its rotation. Furthermore, in the portion of the trunnion 7 opposite the recesses 13, 14 (or **13*a*, 14*a*) the trunnion has a flat 20 the shortest distance of which from the axis, indicated at 21, of the trunnion is less than the shortest distance between the end of the locking finger 12 (or 12*a*) and said axis 21. In other words, when the prop is brought into the position shown in FIG. 4 in which the locking finger 12 (or 12*a*) arrives in the region of the flat 20, and even assuming that no pull is exerted on the prop rod 10 in the direction of its axis, the end of the locking finger is slightly spaced from the plane of the flat 20.**

Finally, it should be noted that the geometrical axes of the trunnions form an angle of less than 180° in the upper portion of the plane in which they are contained and which is perpendicular to the axis of the firearm. This angle has been indicated by the letter A in FIG. 7 and the plane in question has been indicated by P.

The operation of the props of the firearm which has just been described is as follows:

In the active or firing position, with no pull exerted on the prop rod 10, the elastic member 15 which rests against the pin 17 pushes the collar 16 upward and the locking finger 12 (or **12*a*) comes to occupy the radial recess 13 (or 13*a*) of the trunnion 7.**

The head 8 of the prop can then not disengage itself from the trunnion since the locking finger is locked in the recess, and furthermore the prop 2 cannot pivot under the action of a force which might result from the weapon being, for instance, carried by the marksman in order to move it or from impacts to which the free ends of the props might be subjected, particularly should they encounter obstacles such as barbed wire underbrush or hillocks, or else if, with the props locked in their active position, the firearm is roughly thrown to the ground.

However, these forces to which the free ends of the prop can be subjected may be relatively great and the locking finger might then suffer stresses such that they might cause the deformation or even the breaking thereof. In this case the embodiment shown as variant in FIG. 6 is particularly advantageous due to the fact that such forces would produce a sliding of the rounded end of the locking finger **12*a* on the flared side walls of the radial housing 13*a*, transforming these forces which are perpendicular to the prop into forces directed along its axis and resulting in the extracting of the locking finger from its recess against the force exerted by the elastic return member 15.**

In order to bring the prop 2 from the active position shown in FIG. 5 to its inactive position shown in FIG. 3, in which position the prop is swung back along the firearm, it is sufficient first of all, without it being necessary to actuate any locking button, to exert a pull on the free end of the rod against the force exerted by the elastic member 15 and of sufficient amplitude so that the locking finger 12 emerges from its recess 13 and, thereupon pivoting the prop in the direction indicated by the arrow 22 until the locking finger comes opposite the radial recess 14. The pull exerted on the prop having ceased, the locking finger 12 can then penetrate into the recess 14 under the action of the elastic return force exerted by the member 15 on the shoulder 16. The prop is then locked in the inactive position.

In order to return the prop from this inactive position to its active position, one proceeds in the same manner, but pivoting the prop in the direction opposite that indicated by the arrow 22.

When using a prop developed in accordance with the embodiment of FIG. 6, one can, of course, proceed in the same manner in order to bring the prop from its active position into its inactive position.

In order to effect the removal of the prop, one proceeds in the following manner:

A pull is exerted on the prop rod 10 in such a manner that the locking finger 12 (or 12*a*) emerges from the housing in which it is engaged, whereupon it is pivoted until this finger arrives in the region of the flat 20. Due to the fact that the collar 19 is interrupted in this region, the prop head 5 can be removed laterally so as to free the trunnion. To do this, and as a result of the precautions of a dimensional nature mentioned above with regard to the position of the flat, it is not even necessary to continue pulling on the end of the prop.

In order to mount the prop, it is placed in such a position (see FIG. 4) that the blind hole 6 of the head 5 can engage on the trunnion, the locking finger being located in the region of the flat. When this engagement has been effected, the prop is pivoted to bring it either into its active position or into its inactive position, and it will be evident that during this pivoting movement, the locking finger will rest at its end on the trunnion 7, which causes a compression of the elastic member 15, and that it prevents any removal of the head before the locking position is reached, due to the fact that it can abut behind the collar 19, preventing any lateral displacement of the head which would tend to remove it from the firearm.

Another important advantage of the invention resides in the double role which is imparted to the pin 17. This pin 17 serves as a matter of fact on the one hand as lower stop for the elastic member 15, while on the other hand it limits the displacements of the prop rod 10 in the bore 9 of the head.

In particular it prevents any removal of the prop from out of the bore if too great an axial force is exerted on the rod in the direction of its axis since the upper wall of the notch 18 then comes against the pin 17. Furthermore, when the prop is in its active position, the end of the locking finger can be prevented from coming against the bottom of the recess 13 (or 13*a*) by suitably positioning the pin 17 so that before this abutment takes place the upper end of the rod 10, namely the lower wall of the notch 18, strikes below the pin.

This arrangement prevents the weight of the firearm being borne by the locking finger, which might subject the latter to excessive stresses or dull the end thereof, which could prevent it from subsequently penetrating into the radial recesses. On the contrary, in accordance with the invention, the weight of the firearm is borne by the pin 17 which, of course, can be made of sufficient size that there is no danger of its being deformed. In this way any deformation of the trunnion is also avoided.

Finally, it will readily be seen that the relative positioning of the geometric axes of the trunnion 7 permits the props, when they occupy their active position, to be sufficiently moved away from each other to impart the firearm sufficient stability in the firing position and to fold back along the firearm when they are brought into their inactive position, since the axis of the props remains perpendicular to the axes 21.

Figure 8:
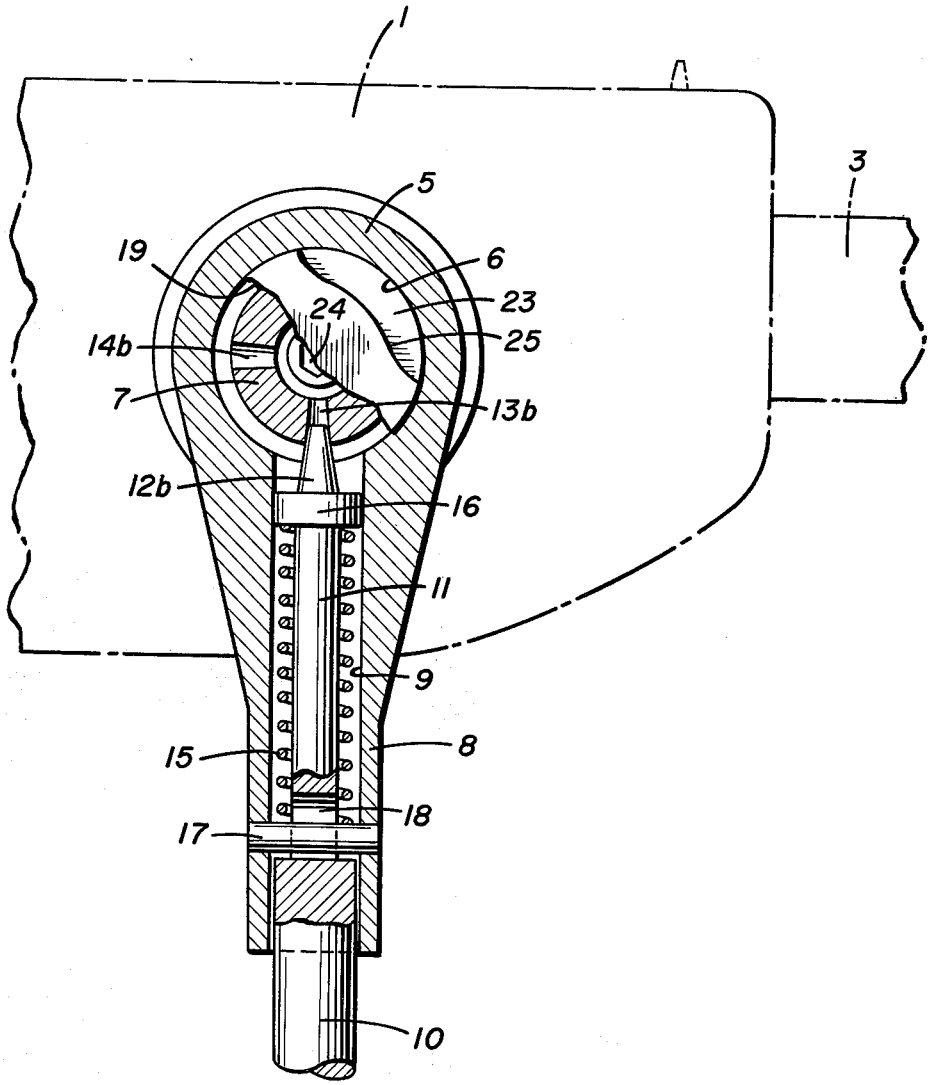

In the embodiment shown in FIG. 8, parts similar to those in FIGS. 5 and 6 have been indicated by the same reference numbers.

The locking finger, marked 12*b*, as well as the recesses, marked 13*b* and 14*b*, with which it is intended to cooperate to assure the locking in the active and inactive positions of the props, are of conical shape.

This shape has the advantage of permitting automatic compensation for the play which might result between the finger and the recesses as a result of wear and furthermore to impart greater strength to the locking finger. Furthermore, a dulling of the end of the finger which might result from repeated blows against the trunnion 7 cannot prevent it from penetrating into the recesses 13*b* and 14*b*.

In this embodiment, a passage 23 has been provided in the collar 19 of the trunnion 7 for the passage of the locking finger 12*b* upon the removal of the prop, but no flat similar to flat 20 has been provided on the trunnion itself, since the latter is made hollow to house a nut 24 for the fastening of the trunnion to the firearm. Therefore, when it is desired to remount the prop, it is necessary to exert a pull on it in the direcion of its axis in order that the end of the locking finger can pass over the peripheral surface 25 of the trunnion.

As goes without saying and as is furthermore already evident from the foregoing, the invention is in no way limited to those of its methods of application or embodiments which have been more particularly contemplated; rather, it covers all variants; in particular, three radial recesses could be provided instead of two, one cooperating with the locking finger to lock the props in an inactive position and the other two cooperating with said finger to lock the props selectively in two active positions which are spaced angularly from each other so as to permit the positioning of the front end of the firearm at two different heights when in firing position.

I claim:

1. A firearm of the type having two props having feet, said props being pivoted to its front portion about two respective laterally protruding trunnions, said props being adapted to occupy at least one active position in which, their feet resting on the ground, they serve as support for the front portion of the firearm so as to maintain it elevated, and an inactive position in which they are swung back along the firearm, each prop comprising:

a prop rod, said prop rod having a foot, a head having a blind hole by means of which it can be engaged over the laterally protruding trunnion on the firearm, and said head having a radial extension, a bore in said radial extension, said bore slidably receiving the end of the prop rod which is opposite its foot, means for axial retention of the head on the trunnion, and within the head, means for the automatic locking of said end on the trunnion in the two aforementioned positions, said means being unlockable under the effect of a pull exerted on the rod in the direction of its axis.

2. A firearm as claimed in claim 1, further comprising: said trunnion having at least two radial recesses therein, an elastic member within the bore of the radial extension of the head, said elastic member urging said end of the rod toward a retracted position in the head, and said end having a locking finger adapted to protrude radially into the blind hole and to cooperate selectively with said at least two radial recesses in the trunnion so as to assure locking in at least the two aforementioned positions.

3. A firearm as claimed in claim 2, wherein the elastic member is compressed between a shoulder of the rod and a fixed stop of the radial extension of the head.

4. A firearm as claimed in claim 3 wherein said rod has a notch therein, the fixed stop is a pin which tranverses the radial extension of the head, as well as the notch in the rod, and the upper and lower walls of said notch, by coming against the pin, serve to limit the sliding movements of the rod in the bore of said extension.

5. A firearm as claimed in claim 2 wherein at least one of said recesses of the trunnion with which the finger cooperates to assure the locking of the prop in an active position has side walls which are flared towards the periphery of the trunnion.

6. A firearm as claimed to claim 5, wherein the end of the locking finger is of rounded shape.

7. A firearm as claimed in claim 6, wherein the trunnion has a small collar at its end opposite the firearm which is adapted to fit in the bottom of the blind hole of the head and guide the latter upon its rotation and, at the portion thereof opposite the said recesses, the trunnion has a flat the shortest distance of which from the axis of the trunnion is less than the shortest distance between the end of the locking finger and the said axis.

8. A firearm as claimed in claim 1 wherein the geometrical axes of the two trunnions form an angle such that in the active position the two props are spread apart from each other in a plane substantially perpendicular to the axis of the firearm, and that upon their rotation towards their inactive position they are folded back along the firearm.

9. A firearm as claimed in claim 8, wherein the geometrical axes of the two trunnions form an angle of less than 180° in the upper portion of the plane, perpendicular to the axis of the firearm, in which they are contained.

* * * * *